United States Patent [19]

Evans et al.

[11] Patent Number: 4,624,329

[45] Date of Patent: Nov. 25, 1986

[54] ROTATING CUTTER DRILL SET

[75] Inventors: Robert F. Evans; Randy C. Davis, both of Dallas, Tex.

[73] Assignee: Varel Manufacturing Company, Dallas, Tex.

[21] Appl. No.: 752,024

[22] Filed: Jul. 5, 1985

Related U.S. Application Data

[63] Continuation-in-part of Ser. No. 580,539, Feb. 15, 1984, abandoned.

[51] Int. Cl.[4] ..... E21B 10/08

[52] U.S. Cl. ..... 175/374; 166/902; 175/331; 175/371

[58] Field of Search ..... 175/374, 327, 371, 372, 175/315, 409, 331; 166/902; 204/147, 196

[56] References Cited

U.S. PATENT DOCUMENTS

| | | | |
|---|---|---|---|
| 2,801,697 | 8/1957 | Rohrback | 166/244 C |
| 2,839,462 | 6/1958 | Nelson | 204/147 |
| 3,091,580 | 5/1963 | Shapiro et al. | 204/147 |
| 3,251,427 | 5/1966 | Ewing | 175/320 |
| 3,442,779 | 5/1969 | Hoey | 204/147 |
| 3,484,349 | 12/1969 | Vrable | 204/147 |
| 3,616,418 | 10/1971 | Anderson et al. | 204/196 |
| 3,649,492 | 3/1972 | Marsh et al. | 204/148 |
| 3,734,181 | 5/1973 | Shaffer | 166/244 C |
| 3,761,145 | 9/1973 | Schumacher, Jr. | 308/8.2 |
| 3,891,394 | 6/1975 | Smith et al. | 166/244 C |
| 3,977,956 | 8/1976 | Bagnulo | 204/196 |
| 3,990,525 | 11/1976 | Penny | 175/337 |
| 4,098,358 | 7/1978 | Klima | 175/65 |
| 4,170,532 | 10/1979 | Tatum | 204/196 |
| 4,194,795 | 3/1980 | Rife | 308/8.2 |
| 4,200,343 | 4/1980 | Highsmith | 175/372 |
| 4,437,957 | 3/1984 | Freeman | 204/147 |
| 4,496,013 | 1/1985 | Serpa | 175/374 |

FOREIGN PATENT DOCUMENTS

| | | | |
|---|---|---|---|
| 578420 | 10/1977 | U.S.S.R. | 175/331 |

OTHER PUBLICATIONS

Corrosion Control in Drilling Operations, Chas. C. Patton.

Corrosion Failures, ASM Committee on Failures by Corrosion.

Getting the Jump on Bearing Corrosion, Design Engineering, M. L. Hoard.

Corrosion and Corrosion Resistance, Kent's Mechanical Engineers' Handbook.

Mud Pump Failure Analysis, Edwin C. Lewis, II.

*Primary Examiner*—James A. Leppink
*Assistant Examiner*—Hoang C. Dang
*Attorney, Agent, or Firm*—Harold E. Meier

[57] ABSTRACT

The present invention relates to a drill bit incorporating one or more rotary cutters. The rotary cutters are supported for rotation by a bearing assembly including ball bearings running in races in the rotary cutter and drill bit body. The bearing assembly further includes an annular bushing. A sealing assembly including an O-ring seal is provided to seal lubricant within the bearing assembly and prevent external contaminants from entering the bearing assembly. A corrosive environment has been found to increase the occurrence of stress fractures in the areas above the juncture of cutter supporting structure and the bit body. It has been found that a sacrificial anode partitioned about the surfaces of the juncture renders the surfaces cathodic and resist stress fracture.

4 Claims, 5 Drawing Figures

ROTATING CUTTER DRILL SET

This application is a continuation-in-part of copending application for U.S. Pat. Ser. No. 580,539 filed Feb. 15, 1984, now abandoned.

TECHNICAL FIELD

This invention relates to drilling bits, and in particular, to drilling with rotating cutter type drill bits.

BACKGROUND ART

Drill bits employing rotary cutters have been used for drilling for many years. The rotary cutters rotate about pins on the drill bit body and have an outside surface that includes cutting structure. This structure commonly takes the form of tungsten carbide inserts. The rotation of the cutter in the cutting area pulverizes the rock of other material for ready removal from the hole by circulating drilling mud.

The cutters are typically secured for rotation to the bit body through a bearing assembly. A bushing is also provided between the bit body and the cutter for support. In the past, the bearing assembly has been sealed from the drilling environment by means of a Belleville seal assembly or an O-ring.

Pressure compensating devices have also been developed to maintain the pressure differential across the Belleville or O-ring seal at a relatively low level to reduce contamination of the bearing under the high pressures encountered in drilling.

While O-ring type seal assemblies have improved the operation of the typical rotating cutter drill bit, the seal assembly has an active service life typically within the range of 100 to 200 hours of drilling. The seal assembly will degrade and permit drilling mud and other fluids present about the drill bit to enter the bearing assembly. Once the bearing assembly is contaminated, the service life is very short. The drilling mud and other fluids about the drill bit commonly contain impurities which quickly abrade the surfaces in the bearing assembly.

The drill bit may also pass through a layer containing hydrogen sulfide. The hydrogen sulfide typically is entrained in the drilling mud in bubble form and quickly acts to destroy the integrity of the O-ring seal assembly. It is common to replace the drill bit whenever a hydrogen sulfide pocket is encountered because the integrity of the seals is almost invariably destroyed.

In an effort to provide longer service life for a drill bit, an effective combination of materials has been developed. The pin or extension of the drill bit body forming the race for the bearings supporting the rotary cutter is formed of forged steel with the bearing race carburized. The bushing between the pin and cutter is formed of a copper alloy. A cobalt alloy surface layer is provided on the pin for contacting the copper alloy bushing. The sealing surfaces of the roller cutter and body against which the O-ring seal acts are formed of a smooth surface having approximately a ten micro inch finish.

Thus, a flat annular surface is formed on the inner surface of the extension of the drill bit body surrounding the slender bolt bearing pin. This annular surface is located in a plane parallel with the plane of the back face of the cutter.

Running in drilling mud, this flat annular surface is outside the sealing point and is subject to a corrosive environment which has been found to initiate and propagate cracks as a result of high stress in the area on the upper side of the bearing pin at the juncture with the drill bit body. It has been well established that in a cyclic loading situation such as found with the running of a drill bit, where a high cyclic tensile stress is produced, fatigue cracks are initiated and propagated at a greatly accelerated rate if a corrosive environment is present.

The cost of replacing a drill bit is expensive and the operation time consuming. Even worse, should a drill bit fail within the hole, resulting in cutter parts or other debris remaining in the hole, a very expensive and time consuming fishing operation is required. Therefore, a need has been shown to improve the service life of the rotary cutter type drill bit while retaining the advantages of its present design and material construction.

DISCLOSURE OF THE INVENTION

In accordance with one aspect of the present invention, a drill bit for drilling is provided. The drill bit includes a body having a cutter support structure and a cutter having cutting structure thereon. A bearing assembly is provided for rotatably supporting the cutter on the cutter support structure of the body. A seal assembly is provided for sealing lubricant within the bearing assembly. The seal assembly includes a flexible seal member for sealed contact with sealing surfaces on the body and cutter. Anticorrosion elements are provided for rendering the surfaces on the body and cutter cathodic with respect to an anodic material proximate thereto outside the bearing assembly. The anticorrosion structure resists deterioration of the sealing surfaces and minimizes stress cracking.

In accordance with another aspect of the present invention, the anticorrosion elements include a material secured to the body proximate the seal assembly. The material is formed of a material higher in the electromotive force series than the material forming the sealing surfaces and acts as a sacrificial anode to protect the sealing surfaces from corrosion and reduces stress induced cracks in the bit body.

BRIEF DESCRIPTION OF DRAWINGS

A more complete understanding of the invention and its advantages will be apparent from the following Detailed Description when taken in conjunction with the accompanying Drawings, in which.

DETAILED DESCRIPTION

Figure 1:
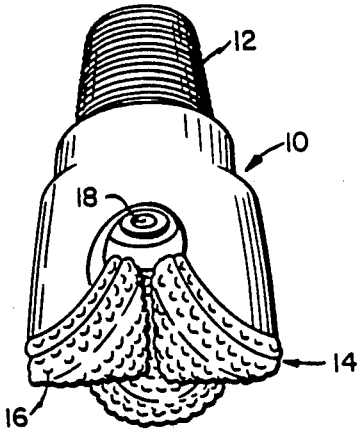
FIG. 1 is a perspective view of a rotary cutter drill bit in which the present invention is incorporated.
Figure 2:
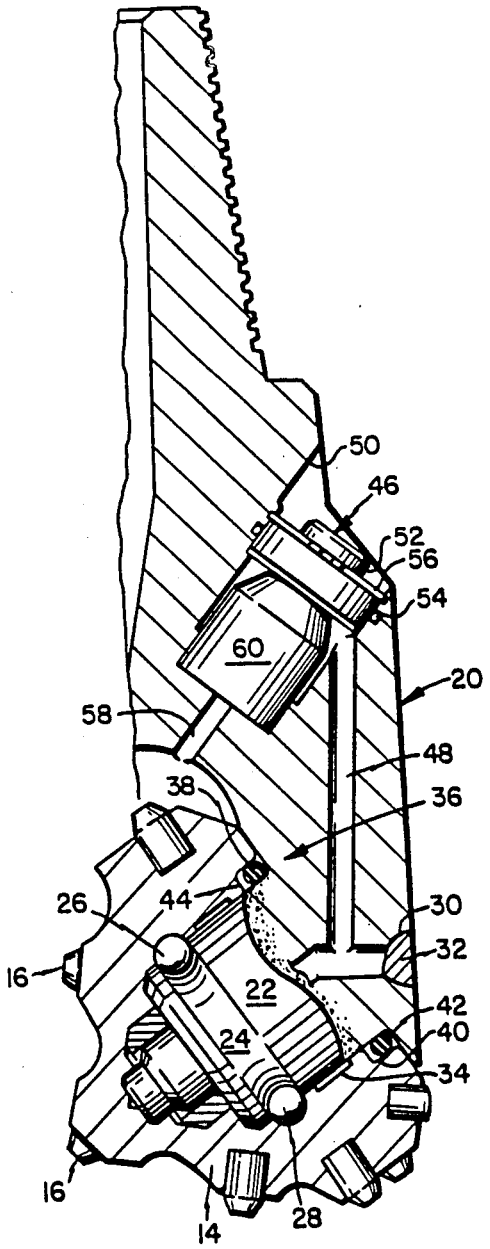
FIG. 2 is a partial cross section of the drill bit illustrating the bearing and sealing assemblies.

Referring now to the drawings, wherein like reference characters designate like or corresponding parts throughout several views, a rotary cutter drill bit 10 typical of those used currently in drilling operations is illustrated in FIGS. 1 and 2. The drill bit 10 is designed for threaded engagement with a drill string through threaded portion 12. The drill string will extend to the surface and be rotated by conventional machinery.

The drill bit 10 has a number of rotary cutters 14 rotatably secured thereon. The rotary cutters have cutting structure 16 on the outside surface thereof. The cutting structure will commonly comprise tungsten carbide inserts. The drill bit 10 illustrated in FIG. 1 includes three rotary cutters positioned at 120° angles about the circumference of the bit. However, any number of rotary cutters can be provided for a particular application.

The drill string transmits a downward force urging the cutting structure of th rotary cutters against the cutting face of the hole being drilled. The cutting structure pulverizes the rock or other material on the cutting face and breaks it into very small pieces. Drilling mud is pumped through the hollow inner core of the drilling string and through aperture 18 in the drill bit to impact upon the cutting face. The drilling mud entrains the particles pulverized by the drill bit. The mud flows upward to the surface about the annular space between the borehole and the drill string to carry the pulverized material to the surface for disposal.

As best shown in FIG. 2, the drill bit 10 includes a drill bit body 20 having three extending pins 22 (only one shown). The pins include a bearing race 24 extending circumferentially about the pin. A similar bearing race 26 is formed within a cylindrical aperture in the rotary cutter 14. The rotary cutter is positioned so that the bearing races are aligned with the pin extending into the cylindrical aperture thereof. Ball bearings 28 are positioned in rolling contact with the bearing races to rotatably secure the rotary cutter on the pin. The ball bearings are entered through an aperture 30 formed in the drill bit and through a hollow center core in the pin (not shown). Upon filling the bearing races with ball bearings, a plug 32 is welded in the aperture 30 to prevent contamination.

An annular bushing 34 is positioned between the rotary cutter and the outer surface of pin 22. The bushing 34 and ball bearings 28 combine with the rotary cutter and pin to form a bearing assembly capable of withstanding the stresses encountered in drilling.

A sealing assembly 36 is provided which acts to isolate the bearing assembly from the environment surrounding the drill bit. The sealing assembly preferably includes a resilient O-ring type seal 38. A notch or fillet 40 is formed about the inner end of the roller cutter 22 at the cylindrical aperture to provide a sealing surface 42 for contact with the O-ring seal. The curvilinear intersection of the pin 22 with the remainder of drill bit 10 forms a sealing surface 44. The drill bit 10 is designed so that the O-ring seal 38 is compressed to a sufficient amount to provide sealed contact with both surfaces 42 and 44. The sealing assembly permits the bearing assembly to be filled with a lubricant to enhance the service life of the drill bit.

A pressure compensating assembly 46 is provided in the drill bit to maintain the pressure differential across the sealing assembly below a predetermined level. A port 48 is formed in the drill bit interconnecting the sealing assembly with a cavity 50. One end of the cavity is sealed from the environment about the drill bit by a cap 52 sealed within the cavity by O-ring 54 and locking ring 56. The opposite end of the cavity 50 communicates to the exterior of the drill bit through port 58. A flexible diaphragm 60 is secured within the cavity. The side of flexible diaphragm 60 in communication with port 48 is filled with lubricant. The port 58 communicates with the opposite side of the diaphragm to permit communication to the outside of the drill bit. The diaphragm 60 maintains the pressure on either side thereof in equilibrium, transmitting the pressure exterior of the drill bit through port 58 to the bearing assembly. The pressure differential across the sealing assembly is thereby maintained below a predetermined level.

While the pressure compensating assembly 46 acts to greatly reduce the pressure differential across the seal assembly, transient pressure changes may induce a pressure differential up to 400 psi across the seal assembly for short periods of time. This also acts to urge the seal axially along the sealing surfaces and leads to degradation of the surfaces.

Also contributing to rapid degradation of the O-ring seal is the drilling environment which often includes fluids that are almost always effective electrolytes for accelerating the corrosion processes. Such substances include sodium chloride and hydrogen sulfide. Other conditions which contribute to the corrosion activity are elevated temperatures in deep wells and in geothermal wells. A high hydrostatic pressure within the well also increases activity.

The drilling mud or fluid passing over the drill bit to remove cuttings is traveling at very high velocities and also contributes to rapid degradation of the O-ring seal. The mud is ladened with abrasive cuttings which continuously scour the surfaces of the drill bit to present a chemically fresh surface during drilling.

Even the lubricant in the bearing assembly may contribute to corrosion if it is combined with drilling fluids. In particular, a common lubricant additive, molybedenum disulfide, can interact with small quantities of water to produce sulfuric acid.

Figure 3:
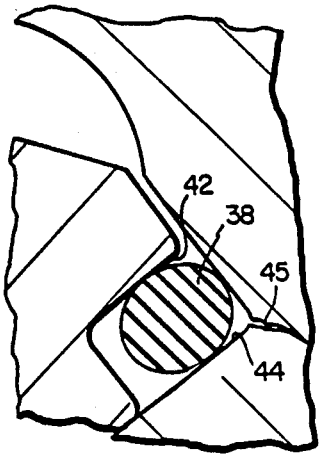
FIG. 3 is an enlarged view of a portion of the corss section of FIG. 2 illustrating the corrosive related fracture damage found in prior art devices.

Referring to FIG. 3, there is shown an enlarged view of the pin 22 at the junction with the bit body 20. This figure illustrates the junction of the pin 22 with the bit body 20 on the inside of the bit body and on the non-pressure or upper side of the bearing pin. That is, with reference to FIG. 2, FIG. 3 illustrates that section of FIG. 2 in the area of the reference numeral 36. This is a high stress area which has been known to produce stress cracks, such as illustrated by the stress fracture 45. These stress fractures have been found to be more likely to occur with the drill bit running in a drilling mud environment which produces a corrosive atmosphere at the juncture of the bit body in the pin outside the O-ring seal 38. Such stress fractures have been found to shorten the life of the bit and may cause the need for a fishing expedition to retrieve broken components of the drill bit from the well.

Figure 4:
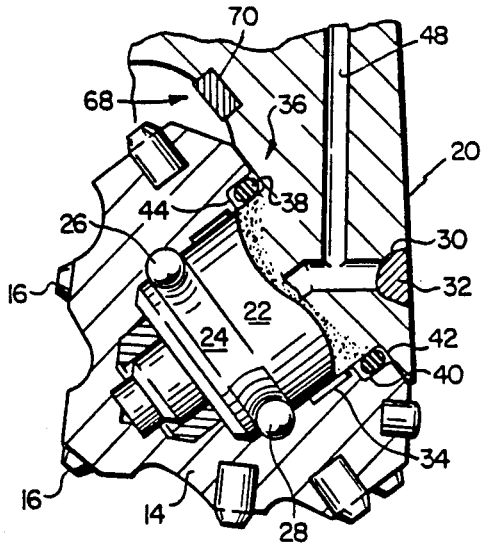
FIG. 4 illustrates a portion of the bearing assembly incorporating the present invention using a sacrificial anode.
Figure 5:
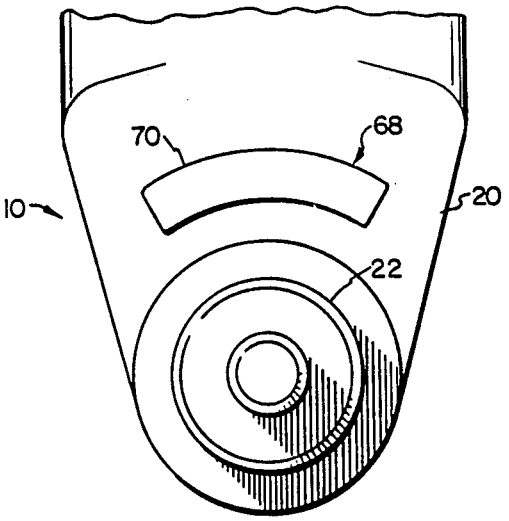
FIG. 5 illustrates an end view of the bearing assembly incorporating the sacrificial anode of FIG. 4.

The present invention reduces the anodic behavior of the bit body 20 to reduce corrosion induce fractures and thereby increase service life. One embodiment of the present invention is illustrated in FIGS. 4 and 5 as a part of the drill bit 10.

This embodiment incorporates the use of a sacrificial anode 68 positioned in close proximity to the sealing assembly 36 in the high tensile stress region. The sacrificial anode 68 is shown in the form of a section of an annular ring 70 in FIGS. 4 and 5. Typically, the section of the annular ring 70 extends in an arc of from 45° to 100°. The ring is secured, as by welding or other similar technique, to the body of the drill bit about the pin 22 and proximate the sealing assembly.

The anode 68 is selected from a material on the electromotive-force series of elements located above the material forming the bit body 20. With the anode 68 having a higher electromotive force, the material of the bit body 20 would always be cathodic with respect thereto. Current flow between the anode 68 and the bit body 20 through the electrolytic material surrounding the drill bit tends to corrode and destroy the anode 68 leaving the bit body in a relatively fracture free condition. The anode, for example, can be made of zinc or a magnesium alloy.

In conclusion, the present invention provides a technique for increasing the service life of rotary cutting drill bits by reducing harmful stress corrosion effects. The invention permits the proven materials in the drill bit to be retained to insure adequate drilling performance. The present invention therefore provides an economical and readily implemented solution to the early failure of rotary cutters and service in drilling.

While only one embodiment of the invention has been illustrated in the accompanying Drawings and described in the foregoing Detailed Description, it will be understood that the invention is not limited to the embodiment disclosed, but is capable of numerous rearrangements, modifications and substitutions of parts and elements without departing from the spirit of the invention.

We claim:

1. A drill bit having protected sealing surfaces comprising:

a body having a cutter support and defining a sealing surface;

a cutter having cutting structure thereon and defining a sealing surface;

a bearing assembly for rotatably supporting said cutter on the cutter support of said body;

a seal assembly including a flexible seal member in sealed contact with said sealing surfaces on said body and cutter; and a sacrificial anode for protecting the sealing surfaces, including a section of an annular ring secured to said body in the immediate area above said cutter support, proximal to the juncture of the body and the cutter support and within proximity of the sealing surfaces, said anode formed of a material higher in the electromotive series than the material forming the surrounding surfaces of said sealing surfaces, such that the sealing surfaces are rendered cathodic with respect to the anode and that the sealing surfaces are in close proximity to the anode during operation of said drill bit.

2. The drill bit of claim 1 wherein said material is selected from the group consisting of: magnesium, and zinc.

3. A rotary drill bit having protected sealing surfaces comprising:

a body having at least one pin extending therefrom and defining a sealing surface, said pin having bearing support structure for receiving supporting bearings;

at least one rotary cutter having cutter structure on its outer surface and an aperture for receiving the pin of said body and defining a sealing surface, the aperture having bearing support structure for receiving supporting bearings;

a plurality of supporting bearings for placement between the bearing support structure of said pin and rotary cutter for rotatably supporting said rotary cutter on said pin;

an annular bushing disposed between said pin and said rotary cutter, said bearing support structure, supporting bearings and bushings forming a bearing assembly;

an O-ring seal for sealing engagement with the sealing surfaces on said body and rotary cutter; and a sacrificial anode for protecting the sealing surfaces, including a section of an annular ring secured to said body in the immediate area above said pin, proximal to the juncture of the body and said pin, and within proximity of the sealing surfaces, said anode formed of a material higher in the electromotive series than the material forming the sealing surfaces, such that the sealing surfaces are rendered cathodic with respect to the anode and such that said surfaces are in close proximity to the anode during operation of said drill bit.

4. A drill bit having protected sealing surfaces comprising:

a drill bit body having at least one cylindrical pin extending therefrom and defining a sealing surface thereon, said pin being formed of forged steel, said pin having a bearing race carburized to enhance wear resistance;

at least one rotary cutter having a cylindrical aperture for receiving said pin; and cutting structure on its outer surface, a bearing race being formed on the inner surface of the cylindrical aperture carburized to enhance wear resistance and the inner surface of said cylindrical aperture defining a sealing surface thereon;

a plurality of bearings for rolling engagement with said bearing races of said pin and rotary cutter;

an annular bushing for positioning between said pin and the inner surface of said aperture, said bushing being formed of a material including a copper alloy, said bearing races, bearings and bushing forming a bearing assembly to rotatably support said rotary cutter on said drill bit;

a resilient O-ring for positioning between said sealing surfaces on said pin and inner surface of said cylindrical aperture to seal lubricant within said bearing assembly and protect said bearing assembly from contaminants, said sealing surfaces defining concentric cylindrical surfaces permitting said seal to move axially along said pin and within said cylindrical aperture while retaining sealing engagement within said seal surfaces; and a sacrificial anode for protecting the sealing surfaces, including a section of an annular ring secured to said body in the immediate area above said pin, proximal to the juncture of the body and the pin, and within proximity of the sealing surfaces, said anode formed of a material higher in the electromotive series than the material forming the sealing surfaces, such that the surfaces are rendered cathodic with respect to the anode and such that the sealing surfaces are in close proximity to said anode during operation of said drill bit.

* * * * *